United States Patent [19]

Shiokawa et al.

[11] Patent Number: 4,773,325

[45] Date of Patent: Sep. 27, 1988

[54] MACHINE PRESS WITH CAM TYPE RAM ACTUATOR

[76] Inventors: Hiroyasu Shiokawa, 9-3, Sone-Nishimachi 4-Chome; Shozo Shiokawa, 3-8-203, Minami-Sakurazuka 1-Chome, both of, Toyonaka City, Prefecture of Osaka 561, Japan

[21] Appl. No.: 53,750

[22] Filed: May 22, 1987

[30] Foreign Application Priority Data

Nov. 19, 1986 [JP] Japan ..... 61-277473

[51] Int. Cl.[4] ..... B30B 1/06

[52] U.S. Cl. ..... 100/282; 100/231; 74/48; 83/628

[58] Field of Search ..... 100/231, 292, 282; 72/452; 74/48, 53, 55; 83/628

[56] References Cited

U.S. PATENT DOCUMENTS

| | | | |
|---|---|---|---|
| 3,302,505 | 2/1967 | Shiokawa . | |
| 3,766,771 | 10/1973 | Spachner et al. | 100/282 X |
| 4,195,564 | 4/1980 | Shiokawa . | |
| 4,480,538 | 11/1984 | Yoshida | 100/282 X |
| 4,638,731 | 1/1987 | Kato | 100/282 |

FOREIGN PATENT DOCUMENTS

| | | |
|---|---|---|
| 42-11916 | 11/1967 | Japan . |
| 54-81574 | 6/1979 | Japan . |

*Primary Examiner*—Andrew M. Falik

*Attorney, Agent, or Firm*—Wenderoth, Lind & Ponack

[57] ABSTRACT

A machine press has a ram that is movable up and down above a work-piece supporting portion formed on one side of a frame, and a double-ended lever pivotably mounted about on a fulcrum shaft extending horizontally in the upper part of the frame, the lever operatively connected to the ram. A cylindrical head is defined at one end of the lever and extends between supporting metal fittings provided on the ram. The other end of the lever is connected to a crank shaft, which extends in the lower part of the frame, through a slider supporting member. The ram is moved up and down above the work-piece supporting portion through the lever which swings under the rotation of the crank shaft. A clutch is operatively connected to the crank shaft and has a driving wheel driven by a motor. A brake is also operatively connected to the crank shaft.

1 Claim, 1 Drawing Sheet

MACHINE PRESS WITH CAM TYPE RAM ACTUATOR

BACKGROUND OF THE INVENTION

1. Field of the Invention

The present invention is related to a machine press in which a ram is movable up and down over a work-piece supporting portion. The work-piece supporting portion is formed on one side of a frame on which the ram is movably supported. The ram is driven under the swinging motion of a lever provided on the frame.

2. Description of the Prior Art

Conventional machine presses include those disclosed in published and examined Utility Model Application No. Sho. 42(1967)-11916 and published unexamined Utility Model Patent Application No. Sho. 54(1979)-81574. These machine presses comprise a partitioned frame having a vertically extending box shape, a crank shaft supported in the lower part of said frame, and a crank pin which turns along one side of the partition connected to a slider supporting member provided on the bottom of a lever which is separately supported, the lever being swung along one side of the partition.

The machines also include a large gear which rotates on the other side of the partition and is connected to the other end of said crank shaft. The large gear is connected to a driving gear which rotates at the upper part of the partition. A rotary shaft projects from the frame at both ends thereof, has the driving gear fitted thereto and is supported in the upper part of the frame. A clutch is operatively connected to one end of said rotary shaft with a driving wheel of the clutch driven by a motor while a brake is operatively connected to the other end of the shaft.

The conventional machine presses described above are deficient in that their structure is complicated. More particularly, because the crank shaft is driven by a gear train consisting of a large gear, a mid gear and a driving gear, and because a rotary shaft which is provided with a clutch and a brake and which drives the gear train extends horizontally in the upper part of the frame, it is impossible to increase the strength of the lever because the swinging stroke of the lever which moves the ram up an down is limited and accordingly,the lever is limited to having small width.

Moreover, due to the aforementioned structure, the center of gravity of the machine is high and the lever which moves the ram up and down swings in a state biased toward one side of the frame, causing dynamic unbalance in the right and left directions.

SUMMARY OF THE INVENTION

For these reasons it is an object of the present invention to improve the above-described type of machine press by making its structure simpler without increasing the floor space required to install it, by increasing the width of the lever to produce a more powerful press, by lowering the center of gravity of the machine press, and by effecting better stability in the right and left sides of the machine press.

To achieve this object, the present invention is drawn to a machine press comprising a ram that is movable up and down above a work-piece supporting portion formed on a side of a frame, and a double-ended lever pivotably mounted on a fulcrum shaft extending horizontally in the upper part of the frame, the lever having a cylindrical head formed at a top end thereof that extends between supporting metal fittings provided in the ram. The bottom end of the lever is connected to a crank shaft, provided in the lower part of the frame, through a slider supporting member. The ram is moved up and down above the work-piece supporting portion by a lever which swings in compliance with the rotation of the crank shaft. Additionally, a clutch is connected to the crank shaft and has a driving wheel driven by a motor while a brake is also connected to the same crank shaft.

The clutch and the brake of the machine press according to the present invention are connected directly to the crank shaft which swings the lever. Accordingly, the structure of the present invention facilitates the object of the present invention in that such structure is simpler than conventional presses, its center of gravity is lower and the stability in the right and left directions is better as again, compared with conventional machine presses in which a gear train is used for driving a clutch shaft. Furthermore, the allowable degree of swing of the lever is larger because the rotary shaft for driving the gear train in the conventional presses is omitted in the present invention. Therefore a more powerful press according to the present invention can be realized by making the width of the lever larger without increasing the size of the machine. Thus, the defects of the conventional machine press are eliminated.

BRIEF DESCRIPTION OF THE DRAWINGS

The present invention will be better understood by referring to the drawings, showing a preferred embodiment of the present invention, in which:

FIG. 2 is a vertical sectional view taken along line II—II of FIG. 1;

FIG. 3 is a vertical sectional view taken along line III—III of FIG. 1.

DETAILED DESCRIPTION OF THE PREFERRED EMBODIMENT

Figure 1:
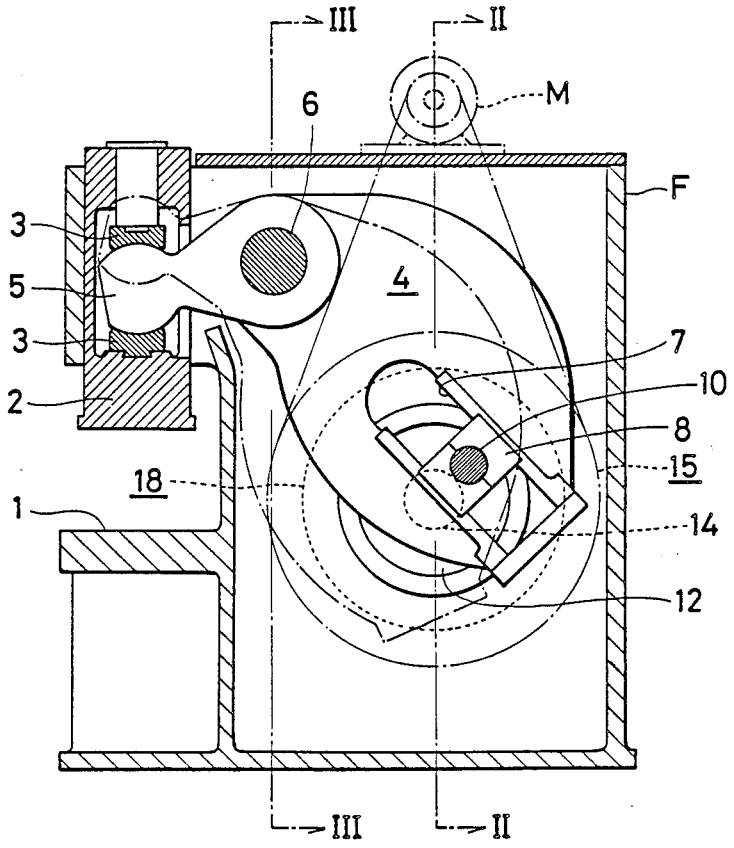
FIG. 1 is a side elevation view, partially in cross section, of a machine press according to the present invention.

Now, the machine press according to the present invention will be explained below with reference to FIGS. 1–3 of the attached drawings.

In the drawings, reference F denotes a box-shaped frame; (1) denotes a work-piece supporting portion formed on one side (front) of the frame F; (2) denotes a ram which can move up and down, the ram facing the top of the work-piece supporting portion (1); (3) denotes supporting metal fittings disposed in the ram (2); (4) denotes a double-ended lever having a cylindrical head (5) at one end which extends between the supporting metal fittings (3), (3), the lever being pivotally mounted on a fulcrum shaft (6) extending horizontally in the upper part of the frame F; (7) denotes a slide guide disposed in a fork-shaped lower end of the lever (4); (8) denotes a slider supporting member extending in the slide guide (7); (9) denotes a crank shaft which is rotatable to pivot the lever (4) via a crank pin (10) mounted in the slider supporting member (8) thereby driving the ram (2) vertically above the work-piece supporting portion (1).

As shown in FIG. 2, the crank shaft (9) consists of a pair of wheels (11), (12) which face each other, are mounted for rotation about the same axis and which respectively support ends of the crank pin (10), a right shaft (13) and a left shaft (14) which comprise one rotatable body at the center of respective wheels (11), (12) and which are supported by the frame F, respectively, and a crank pin (10). The crank shaft (9) is provided with a friction clutch (15), which is actuated by compressed air, at the outer end of the right shaft (13). The outer end of the right shaft projects from one side of the frame F, and the crank shaft (a) is driven by a motor M provided on the top of the frame F via a belt (17) stretched between a driving wheel (16) of the friction clutch (15) and the motor M as shown in FIG. 3. The left shaft (14) projects from the other side of the frame F and is provided with a friction brake (18) which is actuated similarly by compressed air.

Now, the operation of the present invention will be more fully described.

The clutch (15) and the brake (18) provided on each end of the crank shaft (9), respectively, are operatively connected to an operation control circuit (not shown) so as to be operated under the control of a transfer valve provided in the circuit. That is to say, when compressed air is fed through a rotary joint (30) which is provided at an inlet (20) located in the center of a clutch cover (19) which covers the outside of the driving wheel (16) and which rotates together with the latter as one body, a clutch cover (21) which is supported in a manner in which it can move in an axial direction within the clutch cover (19), is pushed inward and presses a friction plate (23), which is fitted to the right shaft (13) by a key (22), against the driving wheel (16) whereby the clutch (15) transmits the rotation of the driving wheel (16) to the right shaft (13) through friction plate (13). And, when compressed air is fed through an inlet (25) located in the center of a brake cover (24) which is fitted onto the outside of the frame F, a brake piston (26) provided inside the brake cover (24) moves axially inward and presses a friction plate (28) against a supporting member (27) thereby braking the left shaft (14) to which the friction plate (28) is fitted by a key (29). Thus, the brake (19) brakes the crank shaft (9).

During operation of the press, i.e. when the crank shaft (9) is rotated about the common axis along which right shaft (13) and left shaft (14) extend by motor M via clutch (15), the wheels (11), (12) are rotated to turn crank pin (10) about said common axis. Accordingly, the supporting member (8) through which the crank pin (10) extends is also turned about said common axis and is caused to slide in slide guide (7) thereby imparting pivotal movement to double-ended lever (4). As the double-ended lever (4) pivots about fulcrum shaft (6) the cylindrical head (5) of the double-ended lever (4) is moved up and down and this up and down movement is transmitted to the ram (2) through the supporting metal fittings (3), (3) disposed within the ram (2). Accordingly, the ram (2) moves and up and down above the work-piece supporting portion (1).

Other modifications and changes in the present invention will become apparent to those of obvious skill in the art. Unless otherwise noted, such are seen to be embraced by the true spirit and scope of the invention which is only intended to be limited by the appended claims.

We claim:

1. A machine press comprising:

a generally box-shaped frame including a pair of opposing side walls, said side walls including respective supporting members;

a ram movably mounted to said frame at an upper front portion thereof for moving up and down relative to said frame, said ram having metal fittings thereon;

a double-ended lever pivotably mounted to said frame for pivoting relative to said frame, said double-ended lever having a cylindrical head defining one end thereof and a forked portion defining the other end thereof, said cylindrical head connected to said ram through said metal fittings, said forked portion generally disposed at the center of said frame;

a fulcrum shaft extending horizontally at the upper portion of said frame and mounted to said frame, said double-ended lever pivotably supported on a center portion of said fulcrum shaft;

a slider supporting means slidably mounted to said double-ended lever in said forked portion thereof so as to be slidable along said forked portion;

a crank shaft connected to said slider supporting means for turning said slider supporting means about an axis spaced from and extending parallel to said fulcrum shaft to pivot said double-ended lever about said fulcrum shaft, said crank shaft comprising a pair of shafts each of which is rotatably suppported about said axis in a respective one of said supporting members, each of said pair of shafts having inner end disposed within said generally box-shaped frame and a respective outer end projecting from said frame, a pair of spaced apart wheels each of which extends from a respective said inner end of said pair of shafts and between which said forked portion of said double-ended lever extends, and a crank pin extending between said pair of wheels at a position offset from said axis, said crank pin extending through said slider support means;

a disk-clutch operatively connected to said crank shaft at the outer end of one of said pair of shafts; and a disk-brake operatively connected to said crank shaft at the outer end of the other of said pair of shafts.

* * * * *

UNITED STATES PATENT AND TRADEMARK OFFICE

CERTIFICATE OF CORRECTION

PATENT NO. : 4,773,325

DATED : September 27, 1988

INVENTOR(S) : Hiroyasu Shiokawa et al.

It is certified that error appears in the above-identified patent and that said Letters Patent is hereby corrected as shown below:

On the cover sheet, below the Abstract, "1 Claim, 1 Drawing Sheet" should read -- 1 Claim, 2 Drawing Sheets --. Figs. 2 and 3 should appear as shown on the attached sheet.

Signed and Sealed this

Twenty-eighth Day of March, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,773,325

DATED : September 27, 1988

INVENTOR(S) : Hiroyasu SHIOKAWA et al.

It is certified that error appears in the above-identified patent and that said Letters Patent is hereby corrected as shown below:

FIG. 2

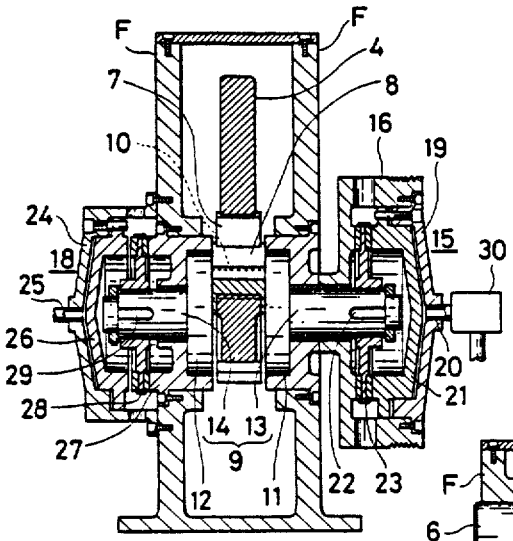

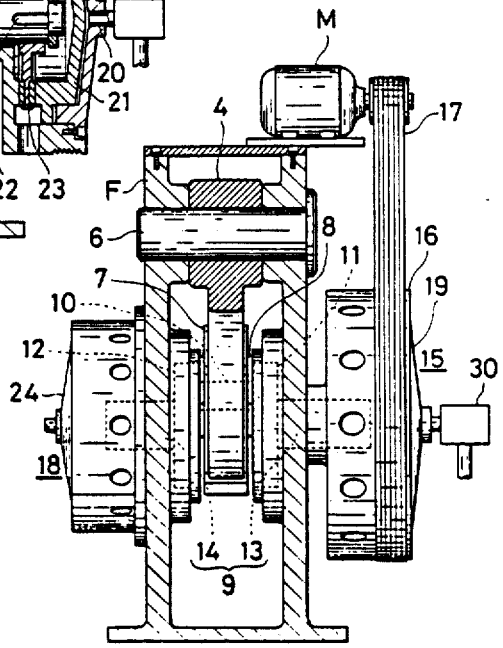

FIG. 3